US008218798B2

(12) United States Patent
Nakamura

(10) Patent No.: US 8,218,798 B2
(45) Date of Patent: Jul. 10, 2012

(54) SOUND PROCESSOR

(75) Inventor: Takeharu Nakamura, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 1076 days.

(21) Appl. No.: 12/155,241

(22) Filed: May 30, 2008

(65) Prior Publication Data

US 2008/0298611 A1 Dec. 4, 2008

(30) Foreign Application Priority Data

May 31, 2007 (JP) ..... 2007-145323

(51) Int. Cl.
*H04R 5/02* (2006.01)
*H04R 5/00* (2006.01)

(52) U.S. Cl. ..... 381/307; 381/1; 381/17; 381/18; 381/19; 381/23; 381/310

(58) Field of Classification Search ..... 381/307, 381/1, 18
See application file for complete search history.

(56) References Cited

U.S. PATENT DOCUMENTS 3,969,588 A * 7/1976 Raydon et al. ..... 381/307
4,352,953 A * 10/1982 Emmer ..... 381/1
4,524,451 A * 6/1985 Watanabe ..... 381/1
4,612,663 A * 9/1986 Holbrook et al. ..... 381/307
5,748,746 A * 5/1998 Ozaki et al. ..... 381/18
6,072,878 A * 6/2000 Moorer ..... 381/18
6,459,797 B1 * 10/2002 Ashour et al. ..... 381/18
7,231,054 B1 * 6/2007 Jot et al. ..... 381/310
2003/0174845 A1 * 9/2003 Hagiwara ..... 381/17
2007/0253575 A1 * 11/2007 Melanson ..... 381/97
2008/0285771 A1 * 11/2008 Tanaka et al. ..... 381/92

FOREIGN PATENT DOCUMENTS

JP 11-215078 8/2008

* cited by examiner

*Primary Examiner* — Elvin G Enad
*Assistant Examiner* — Christina Russell
(74) *Attorney, Agent, or Firm* — McGinn IP Law Group, PLLC

(57) ABSTRACT

A sound processor includes N (N is an integer of five or more) speakers, a sound source configured to output N sound signals an additional sound source configured to output an additional sound signal and a coefficient data input section configured to input N pieces of position information indicating respectively positions of the N speakers and N coefficients indicating respectively volumes of sounds outputted from the N speakers based on the additional sound signal a coefficient data analysis section configured to generate M (M is an integer equal to or greater than two and smaller than N) adjustment coefficients based on said N pieces of position information and the N coefficients wherein the M adjustment coefficients indicate volumes of sounds outputted from M speakers of the N speakers based on the additional sound signal.

9 Claims, 8 Drawing Sheets

SOUND PROCESSOR

INCORPORATION BY REFERENCE

This application is based upon and claims the benefit of priority from Japanese patent application No. 2007-145323, filed on May 31, 2007, the disclosure of which is incorporated herein in its entirely by reference.

BACKGROUND OF THE INVENTION

1. Field of the Invention

The present invention relates to a sound processor for surround system and a sound processing method.

2. Description of Related Art

In recent years, N.1 channel surround systems have spread to movie theaters and homes.

For example, in a movie theater, N speakers are installed in front, back, left and right of auditorium seats (listeners) such that the N speakers surround the auditorium seats. In this case, N is often several tens or so. Moreover, in the movie theater, a speaker exclusively for bass sound called a subwoofer is often installed in addition to the N speakers. Since the subwoofer is used to output sounds of gunfire, footsteps of dinosaurs or the like belonging to a limited range of sound frequencies, the subwoofer is counted as 0.1 channel, as one that is below one channel. The speakers enable the listeners to percept powerful sounds outputted from the speakers.

For example, in home use, N speakers are installed in front, back, left and right of a user (listener) such that the N speakers surround the listener. Since it is difficult to install a large-scale surround system like one in movie theaters in a house, N is five to seven or so, for example. In the case of N being five, five speakers are arranged in the left front, the front, the right front, the left rear, and the right rear (the left side, the center side, the right side, the surround left side, and the surround right side) of the listener, respectively.

FIG. 1 shows a general sound processor. FIG. 2 shows a N.1 channel surround system (N is an integer of five or more) to which the general sound processor is applied.

As shown in FIG. 1, the sound processor includes N speakers 101-1 to 101-N, a sound source 102, an additional sound source 103, a coefficient data input section 104, an additional sound processing section 105, and a sound superimposition section 106.

As shown in FIG. 2, the N speakers 101-1 to 101-N are arranged in a room such that the N speakers 101-1 to 101-N surround a listener 100. The N speakers 101-1 to 101-N are arranged based on a N.1 channel surround system.

The sound source 102 outputs sound signals. The additional sound source 103 outputs an additional sound signal.

The sound processor is given with coefficient data, and the coefficient data input section 104 inputs the coefficient data into the additional sound processing section 105. The coefficient data includes N coefficients. The N coefficients indicate volumes of sounds outputted from the N speakers 101-1 to 101-N based on the additional sound signal, respectively.

The additional sound processing section 105 generates N adjusted additional sound signals by multiplying the additional sound signal by the N coefficients, respectively.

The sound superimposition section 106 generates N superimposed sound signals by superimposing the N adjusted additional sound signals on the sound signals, respectively. The N speakers 101-1 to 101-N output sounds based on the N superimposed sound signals, respectively.

A method of superimposing sounds will be described in addition to the above-mentioned sound processor.

Japanese Laid Open patent Application (JP-A-Heisei 11-215078) discloses a mixer which combines arbitrarily a plurality of pieces of sound information inputted into the mixer and then outputs the results. The mixer includes an input channel device having a plurality of input channels, a bus-select switch device having a plurality of bus-select switches formed in a matrix, and an output channel device having a plurality of output channels. Below given is an exemplary case that first and second sound signals inputted into first and third input channels (input channels 1 and 3) of the plurality of input channels are mixed and the resulting superimposed sound signal is outputted from a third output channel (output channel 3) of the plurality of output channels. In this case, the first and second sound signals are superimposed by setting a bus-select switch of the first row and the second column of the matrix and a bus-select switch of the third row and the second column of the matrix (bus-select switches i12 and i32 of the plurality of bus-select switches) to on state. In the case of the mixer disclosed in Japanese Laid Open patent Application (JP-A-Heisei 11-215078), it is necessary to provide the bus-select switches between the input channels and the output channels. This may cause a problem of introducing enlargement of a circuit scale and an increase in sequence.

In the above-described sound processor, the additional sound signals are superimposed on the sound signals for all the speakers 101-1 to 101-N and all the speakers 101-1 to 101-N output superimposed sounds based on the resulting superimposed sound signals. For example, there is a case that additional sound is desired to be heard by the listener 100 from left and center directions with respect to the listener 100. Even in this case, the superimposed sounds each of which includes the sound based on the sound signal and the additional sound based on the additional sound signal superimposed on the sound signal are outputted from all the speakers 101-1 to 101-N. Such art has room to improve.

SUMMARY

In one embodiment, a sound processor includes N (N is an integer of five or more) speakers, a sound source, an additional sound source, a coefficient data input section, a coefficient data analysis section, an additional sound processing section, and a superimposition section. The sound source outputs N sound signals. The additional sound source outputs an additional sound signal. The coefficient data input section inputs N pieces of position information indicating respectively positions of the N speakers and N coefficients indicating respectively volumes of sounds outputted from the N speakers based on the additional sound signal. The coefficient data analysis section generates M (M is an integer equal to or greater than two and smaller than N) adjustment coefficients based on the N pieces of position information and the N coefficients. The M adjustment coefficients indicate volumes of sounds outputted from M speakers of the N speakers based on the additional sound signal. The additional sound processing section generates M adjusted additional sound signals based on the additional sound signal and the M adjustment coefficients. The superimposition section generates M superimposed sound signals by superimposing respectively the M adjusted additional sound signals on M sound signals of the N sound signals. The M speakers output respectively sounds based on the M superimposed sound signals. Remaining (N-M) speakers of the N speakers output respectively sounds based on remaining (N-M) sound signals of the N sound signals.

In another embodiment, a controller for sound processing includes a coefficient data input section, a coefficient data analysis section, an additional sound processing section, and a superimposition section. The coefficient data input section inputs N (N is an integer of five or more) pieces of position information indicating respectively positions of N speakers and N coefficients indicating respectively volumes of sounds outputted from the N speakers based on an additional sound signal outputted from an additional sound source. The coefficient data analysis section generates M (M is an integer equal to or greater than two and smaller than N) adjustment coefficients based on the N pieces of position information and the N coefficients. The M adjustment coefficients indicate volumes of sounds outputted from M speakers of the N speakers based on the additional sound signal. The additional sound processing section generates M adjusted additional sound signals based on the additional sound signal and the M adjustment coefficients. The superimposition section configured to generate M superimposed sound signals by superimposing respectively the M adjusted additional sound signals on M sound signals of N sound signals outputted from a sound source. The M speakers output respectively sounds based on the M superimposed sound signals. Remaining (N-M) speakers of the N speakers output respectively sounds based on remaining (N-M) sound signals of the N sound signals.

In another embodiment, a sound processing method includes: outputting N (N is an integer of five or more) sound signals corresponding to N speakers; outputting an additional sound signal; inputting N pieces of position information indicating respectively positions of the N speakers and N coefficients indicating respectively volumes of sounds outputted from the N speakers based on the additional sound signal; generating M (M is an integer equal to or greater than two and smaller than N) adjustment coefficients based on the N pieces of position information and the N coefficients wherein the M adjustment coefficients indicate volumes of sounds outputted from M speakers of the N speakers based on the additional sound signal; generating M adjusted additional sound signals based on the additional sound signal and the M adjustment coefficients; and generating M superimposed sound signals by superimposing respectively the M adjusted additional sound signals on M sound signals of the N sound signals. The M speakers output respectively sounds based on the M superimposed sound signals. Remaining (N-M) speakers of the N speakers output respectively sounds based on remaining (N-M) sound signals of the N sound signals.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION OF PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

(Configuration)

Figure 1:
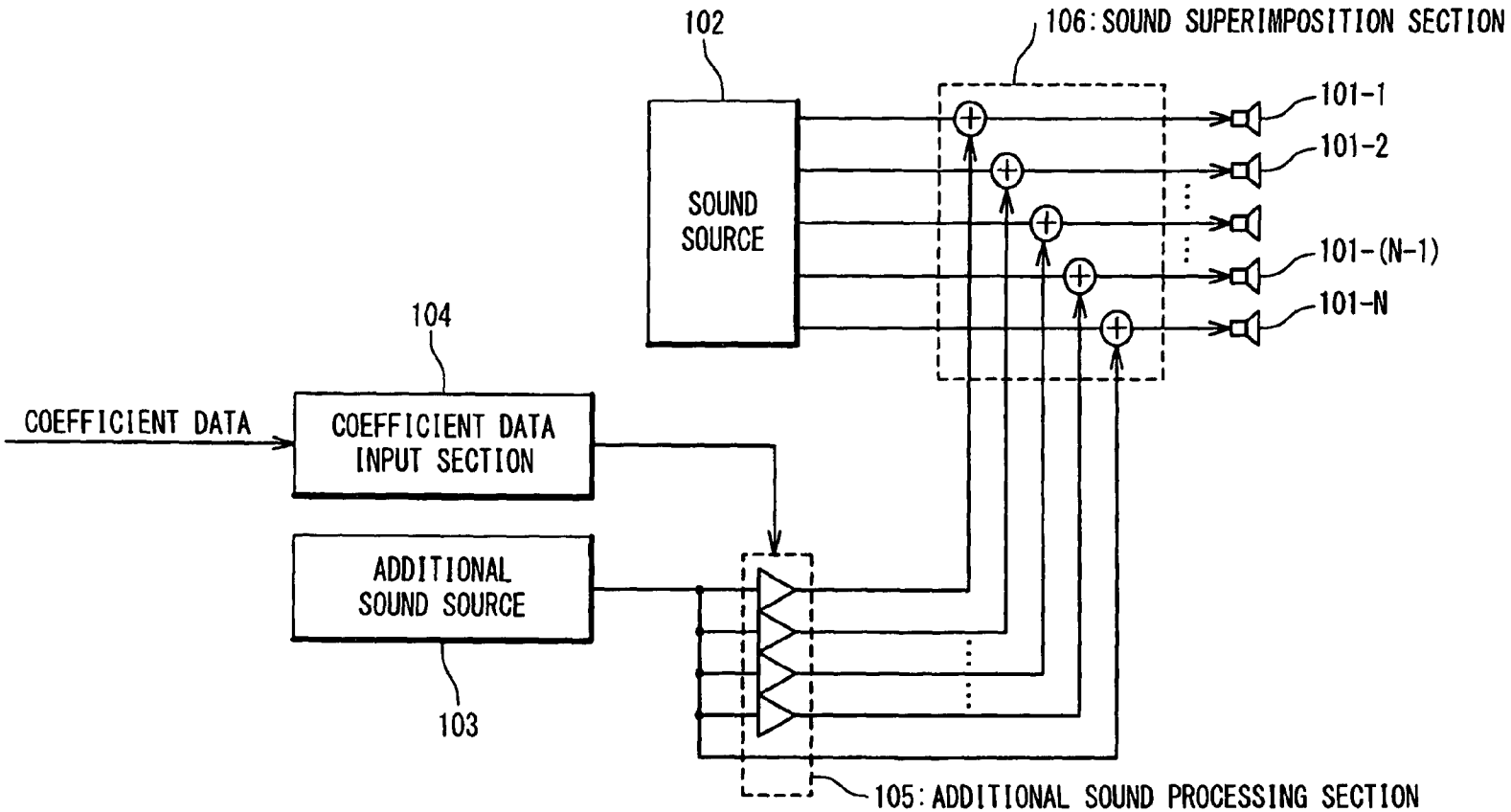
Fig. 1 PRIOR ART
FIG. 1 shows a general sound processor.
Figure 2:
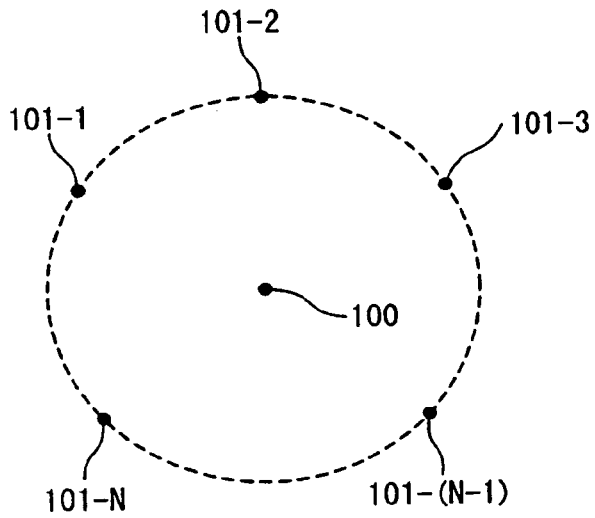
Fig. 2 PRIOR ART
FIG. 2 shows a N.1 channel surround system (N is an integer of five or more) to which the general sound processor is applied.
Figure 3:
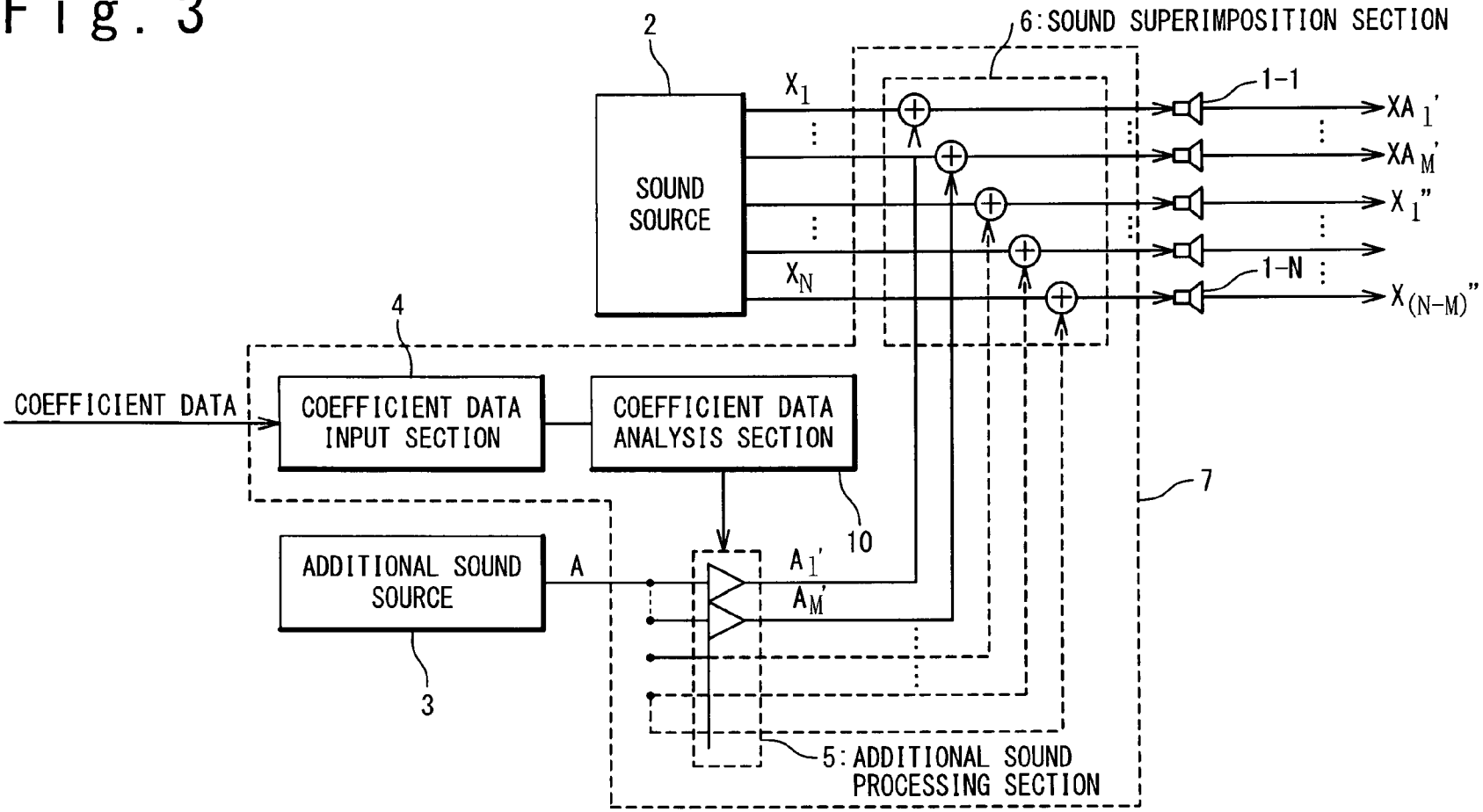
FIG. 3 shows a sound processor according to a first embodiment of the present invention.
Figure 4:
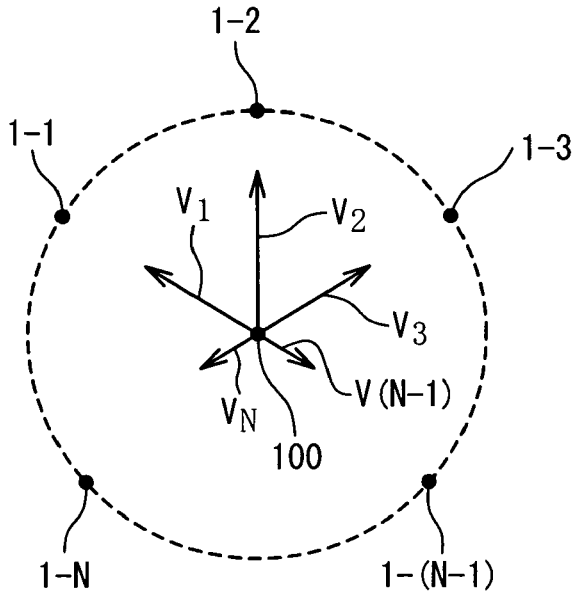
FIG. 4 shows a N.1 channel surround system (N is an integer of five or more) to which the sound processor according to the first embodiment is applied.

FIG. 3 shows a configuration of a sound processor according to a first embodiment of the present invention. FIG. 4 shows a N.1 channel surround system (N is an integer of five or more) to which the sound processor is applied.

As shown in FIG. 3, the sound processor according to the present embodiment includes N speakers 1-1 to 1-N, a sound source 2, an additional sound source 3, and a controller 7. The controller 7 includes a coefficient data input section 4, an additional sound processing section 5, a sound superimposition section 6, and a coefficient data analysis section 10.

The controller 7 is implemented by hardware such as circuits or software such as computer programs. When the controller 7 is a computer for sound processing and the coefficient data input section 4, the additional sound processing section 5, the sound superimposition section 6, and the coefficient data analysis section 10 are implemented by computer programs, the sound processing computer 7 further includes a storage section for storing the computer programs, and a CPU (Central Processing Unit) for executing the computer programs stored in the storage section.

As shown in FIG. 4, the N speakers 1-1 to 1-N are arranged in a room such that the N speakers 1-1 to 1-N surround a listener 100. The N speakers 1-1 to 1-N are arranged based on the N.1 channel surround system.

The coefficient data analysis section 10 recognizes positions in which the N speakers 1-1 to 1-N are arranged. For example, the coefficient data analysis section 10 includes a storage section to store N pieces of position information indicating the positions of the N speakers 1-1 to 1-N. The positions of the N speakers 1-1 to 1-N are determined based on standards according to the N.1 channel surround system.

For example, there is a case that the listener 100 changes the positions of the N speakers 1-1 to 1-N. In this case, the listener 100 has the N pieces of changed position information indicating the changed positions stored in the storage section of the coefficient data analysis section 10. These N pieces of changed position information are used as the N pieces of position information.

(Operation)

Figure 5:
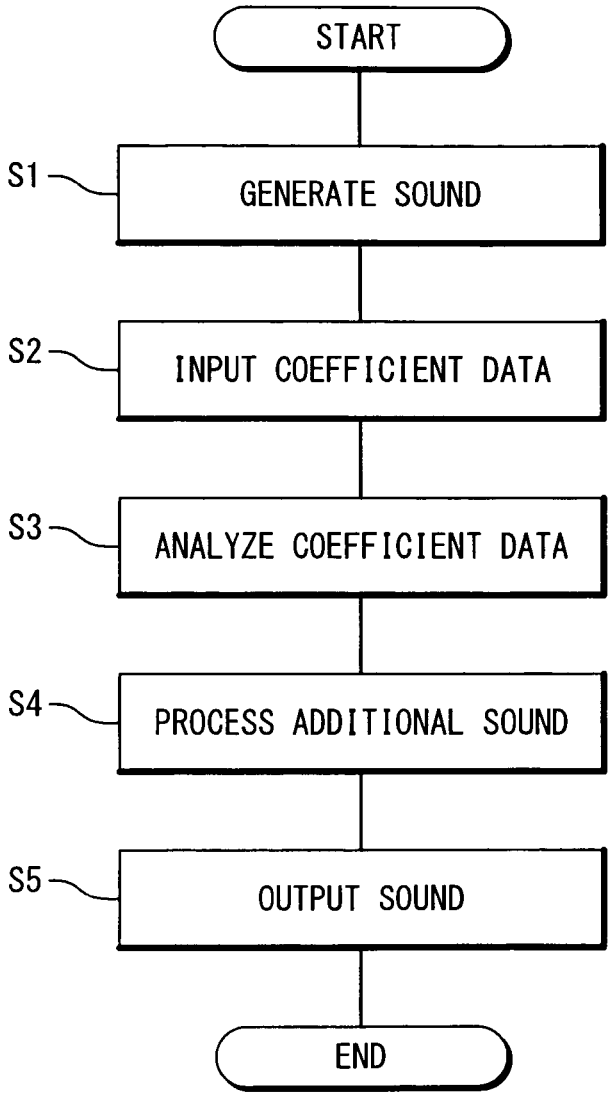
FIG. 5 is a flowchart illustrating operation of the sound processor according to the first embodiment.

FIG. 5 is a flowchart illustrating operation of the sound processor according to the present embodiment.

First, the sound source 2 outputs sound signals and the additional sound source 3 outputs an additional sound signal (Step S1; sound generation processing).

The sound processor according to the present embodiment is given with coefficient data, and the coefficient data input section 4 inputs the coefficient data into the coefficient data analysis section 10. The coefficient data includes the N pieces of position information and N coefficients. The N pieces of position information indicate the positions of the N speakers 1-1 to 1-N, respectively. The N coefficients respectively indicate volumes of additional sounds outputted from the N speakers 1-1 to 1-N based on the additional sound signal (Step S2; coefficient data input processing).

The coefficient data analysis section 10, based on the N pieces of position information and the N coefficients, generates M adjustment coefficients indicating volumes of additional sounds outputted from M speakers of the N speakers 1-1 to 1-N based on the additional sound signal, respectively (Step S3; coefficient data analysis processing). Here, M is an integer equal to or greater than two and smaller than N.

The additional sound processing section 5 generates M adjusted additional sound signals based on the additional sound signal and the M adjustment coefficients by multiplying the additional sound signal by the M adjustment coefficients, respectively (Step S4; additional sound processing).

The sound superimposition section 6 superimposes the M adjusted additional sound signals on the sound signals to generate M superimposed sound signals, respectively. The M speakers output M superimposed sound based on the M superimposed sound signals, respectively. The remaining (M-N) speakers of the N speakers output (M-N) sounds based on the sound signals, respectively (Step S5; sound output processing).

Descriptions relevant to the sound generation processing (Step S1) will be given.

In the sound generation processing (Step S1), as shown in FIG. 3, the sound source 2 outputs the sound signals $X_1$ to $X_N$ respectively corresponding to the speakers 1-1 to 1-N. The additional sound source 3 outputs the additional sound signal A.

Descriptions relevant to the coefficient data input processing (Step S2) will be given.

The coefficient data input section 4 receives the coefficient data described below and inputs the received data into the coefficient data analysis section 10. The coefficient data includes information indicating that the listener 100 hears sound in how much volume (coefficient) and from the speaker of which channel (position, in this case, from which direction). As shown in FIG. 4, the coefficient data is expressed by N vectors. In this case, the initial points of the N vectors correspond to the listener 100. Magnitudes $|V_1|$ to $|V_N|$ of the N vectors respectively indicate the N coefficients of the coefficient data. Directions of the N vectors respectively indicate the positions indicated by the N pieces of position information of the coefficient data.

Descriptions relevant to the coefficient data analysis processing (Step S3) will be given.

The N vectors and their directions determine a virtual sound source vector. The terminal point of the virtual sound source vector corresponds to a virtual additional sound source. The virtual additional sound source is assumed as a monopole. Moreover, angles between the virtual sound source vector and the N vectors are designated by $\theta_1$ to $\theta_N$, respectively. In this case, the coefficient data analysis section 10 calculates a magnitude $|V|$ of the virtual sound source vector based on the following formula:

$$|V|=|V_1|\cos\theta_1+\ldots+|V_N|\cos\theta_N.$$

Based on the result of the calculation, the coefficient data analysis section 10 selects the M (M is an integer equal to or greater than two and smaller than N) speakers from the N speakers 1-1 to 1-N in order of proximity to the terminal point of the virtual sound source vector (or in order of proximity to the virtual additional sound source).

Angles between the virtual sound source vector and the M vectors of the N vectors, corresponding to the M speakers are designated by $\theta_1'$ to $\theta_M'$, respectively. The M adjustment coefficients are designated by $G_1'$ to $G_M'$, respectively. In this case, the coefficient data analysis section 10 calculates the M adjustment coefficients $G_1'$ to $G_M'$ based on the following formulae:

$$G_1'=|V|\cos\theta_1',\ldots,G_M'=|V|\cos\theta_M'.$$

Descriptions relevant to the additional sound processing (Step S4) will be given.

The additional sound signal is designated by A. In this case, the additional sound processing section 5 calculates the M adjusted additional sounds $A_1'$ to $A_M'$ based on the following formulae:

$$A_1'=A\times G_1',\ldots,A_M'=A\times G_M'.$$

Descriptions relevant to the sound output processing (Step S5) will be given.

The sound signals are designated by $X_1$ to $X_N$. Here, the sound signals of the sound signals $X_1$ to $X_N$, corresponding to the M speakers are designated by $X_1'$ to $X_M'$, respectively. Moreover, the remaining sound signals corresponding to the remaining (N-M) speakers are designated by $X_1''$ to $X_{(N-M)}''$, respectively. In this case, the sound superimposition section 6 calculates respectively the M superimposed sound signals $XA_1'$ to $XA_M'$ based on the following formulae:

$$XA_1'=X_1'+A_1',\ldots,XA_M'=X_M'+A_M'.$$

The sound superimposition section 6 sends the M superimposed sound signals $XA_1'$ to $XA_M'$ to the M speakers and sends the sound signals $X_1''$ to $X_{(N-M)}''$ to the remaining (N-M) speakers, respectively. The M speakers output sounds based on the M superimposed sound signals $XA_1'$ to $XA_M'$, respectively. The remaining (N-M) speakers output sounds based on the sound signals $X_1''$ to $X_{(N-M)}''$, respectively.

According to the present embodiment, a new N.1 channel surround system is provided (N is an integer of five or more). For example, there is a case where it is demanded that the listener 100 hears the additional sounds from left and right directions with respect to the listener 100. In this case, the general sound processor described above can not realize the demand, since the additional sound signal is superimposed on the sound signals for all speakers 101-1 to 101-N and the speakers 101-1 to 101-N output sounds based on the superimposed sound signals. On the other hand, the sound processor according to the present embodiment selects the speaker arranged in left side of the listener 100 and the speaker arranged in right side of the listener 100 as the M (M is an integer equal to or greater than two and smaller than N) speakers from the N speakers 1-1 to 1-N based on the N coefficients (magnitudes $|V_1|$ to $|V_N|$ of the vectors) and the N pieces of position information (directions of the vectors) of the coefficient data, sends the superimposed sound signals to the left speaker and the right speaker, and sends the sound signals to the remaining (other) speakers. The left speaker and the right speaker output sounds based on the superimposed sound signals. The remaining speakers output sounds based on the sound signals. As describe above, the sound processor according to the present embodiment enables that number of the channels (speakers) which output the additional sounds is changed from N to M. Relevant to this, concrete descriptions will be given.

EXAMPLES

The operation of the sound processor according to the present embodiment will be described concretely using FIGS. 6 to 9.

As shown in FIGS. 6 to 9, N is assumed to be five. That is, the sound processor according to the present embodiment is applied to 5.1 channel surround system, and the five speakers 1-1 to 1-5 are arranged in the room such that the five speakers surround the listener 100.

Figure 7:
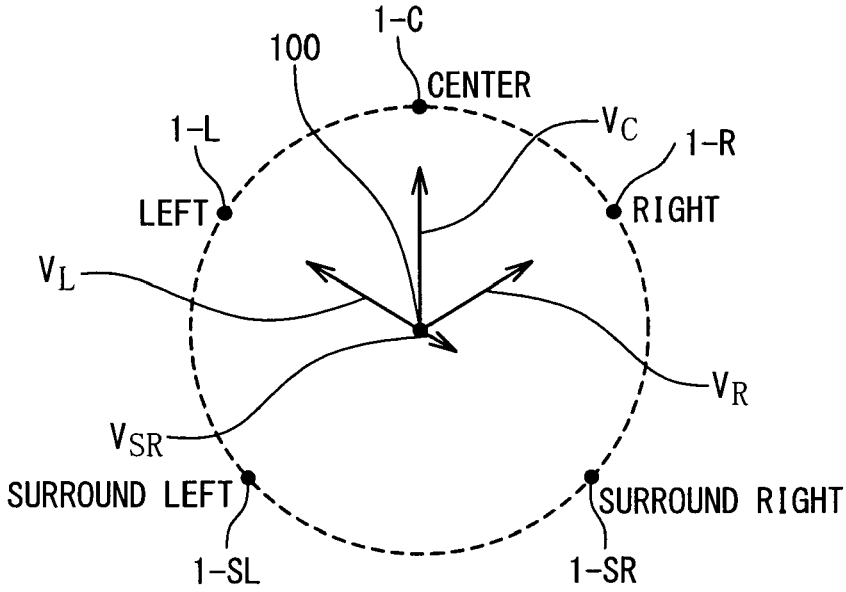
FIG. 7 illustrates operation of the sound processor according to the first embodiment to which the 5.1 channel surround system is applied.

In this case, as shown in FIG. 7, the speakers 1-1 to 1-5 are referred to as speakers 1-L, 1-C, 1-R, 1-SL, and 1-SR. The speakers 1-L, 1-C, 1-R, 1-SL, and 1-SR are arranged on the left side, the center side, the right side, the surround left side, and the surround right side with respect to the listener 100, respectively.

Figure 6:
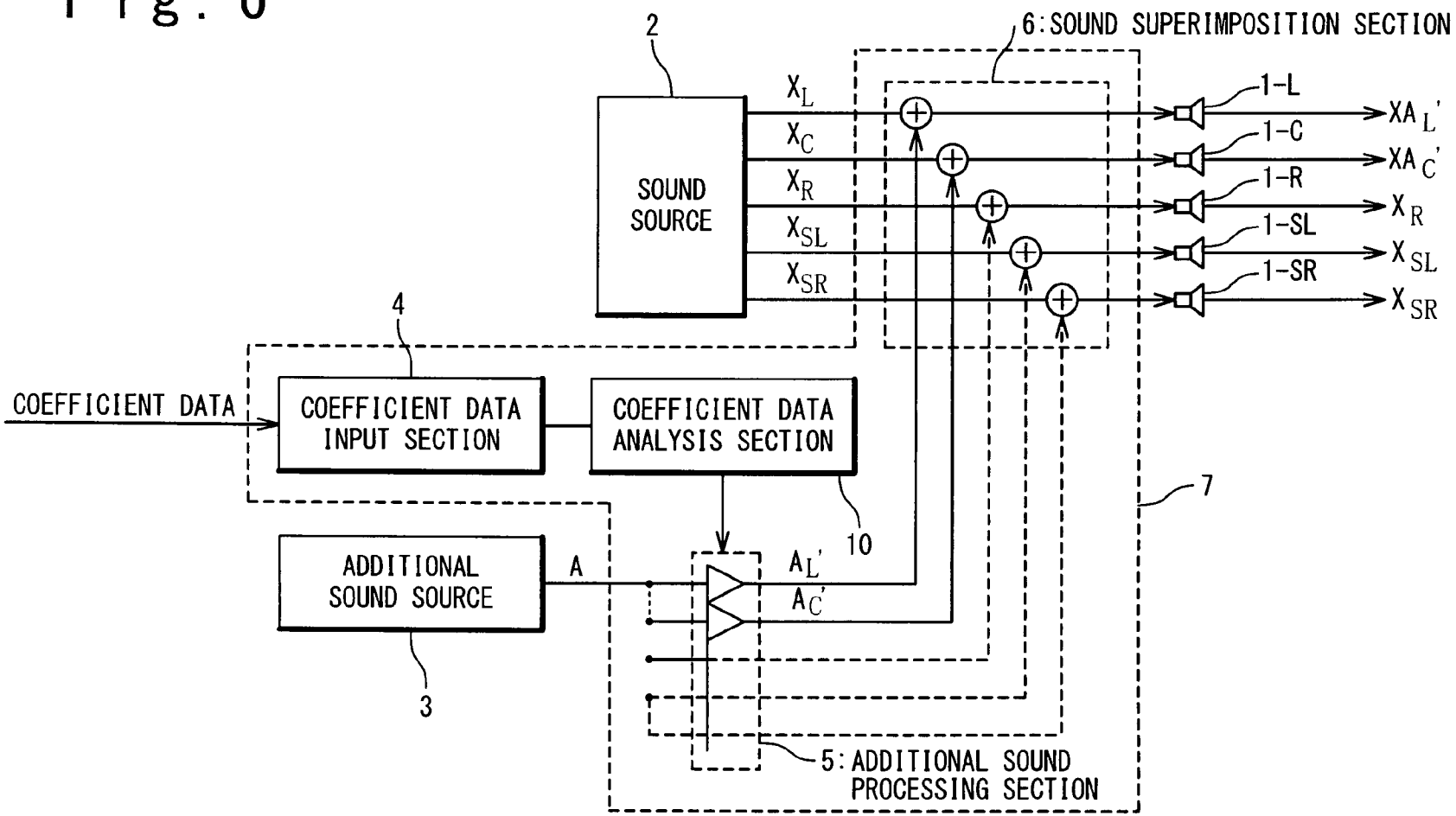
FIG. 6 shows the sound processor according to the first embodiment to which the 5.1 channel surround system is applied.

In the sound generation processing (Step S1), as shown in FIG. 6, the sound source 2 outputs sound signals $X_L$, $X_C$, $X_R$, $X_{SL}$, and $X_{SR}$ as the sound signals $X_1$ to $X_5$ corresponding to the speakers 1-L, 1-C, 1-R, 1-SL, and 1-SR. The additional sound source 3 outputs the additional sound signal A.

In the coefficient data input processing (Step S2), the coefficient data input section 4 inputs the coefficient data including five pieces of position information (direction information) and five coefficients into the coefficient data analysis section 10. As shown in FIG. 7, the five coefficients of the coefficient data correspond to magnitudes $|V_L|$, $|V_C|$, $|V_R|$, $|V_{SL}|$, and $|V_{SR}|$ as the magnitudes of the five vectors $V_1$ to $V_5$, respectively. The five pieces of position information of the coefficient data correspond to the left, the right, the center, the surround left, and the surround right as the directions of the five vectors, respectively. In this case, the initial points of the five vectors correspond to the listener 100.

In the coefficient data analysis processing (Step S3), the five vectors and their directions determine the virtual sound source vector. The terminal point of the virtual sound source vector corresponds to the virtual additional sound source. The virtual additional sound source is assumed as a monopole. Moreover, the angles $\theta_1$ to $\theta_5$ between the virtual sound source vector and the five vectors are designated by $\theta_L$, $\theta_C$, $\theta_R$, $\theta_{SL}$, and $\theta_{SR}$, respectively.

Moreover, the magnitude $|V_{SL}|$ of the vector $V_{SL}$ is assumed to be zero. In this case, the coefficient data analysis processing (Step S3) is performed on four vectors ($V_L$, $V_C$, $V_R$, and $V_{SR}$) except the vector indicating the magnitude $|V_{SL}|$ from the five vectors ($V_L$, $V_C$, $V_R$, $V_{SL}$, and $V_{SR}$).

Figure 8:
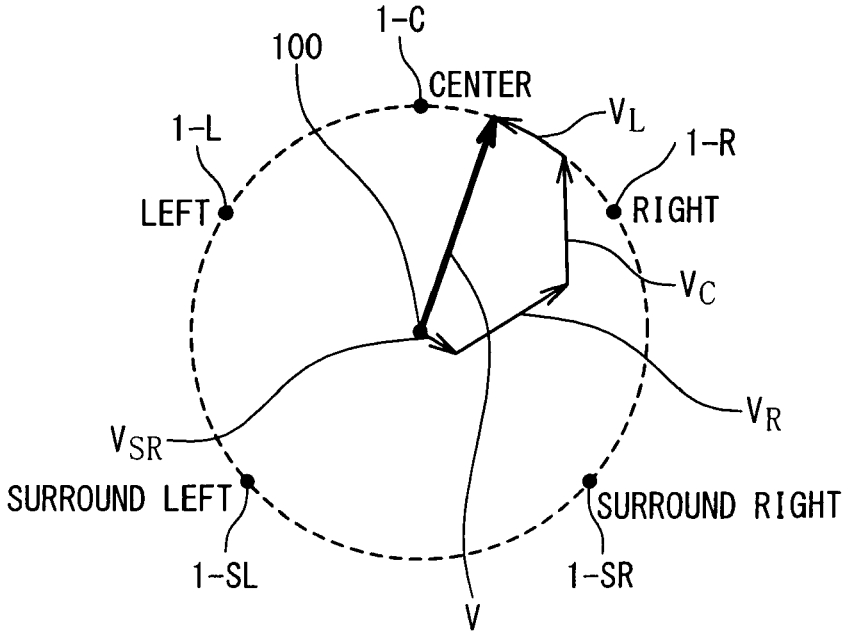
FIG. 8 illustrates operation of the sound processor according to the first embodiment to which the 5.1 channel surround system is applied.

Then, as shown in FIG. 8, the coefficient data analysis section 10 calculates the magnitude $|V|$ of the virtual sound source vector based on the following formula:

$$|V|=|V_L|\cos\theta_L+|V_C|\cos\theta_C+|V_R|\cos\theta_R+|V_{SR}|\cos\theta_{SR}.$$

Figure 9:
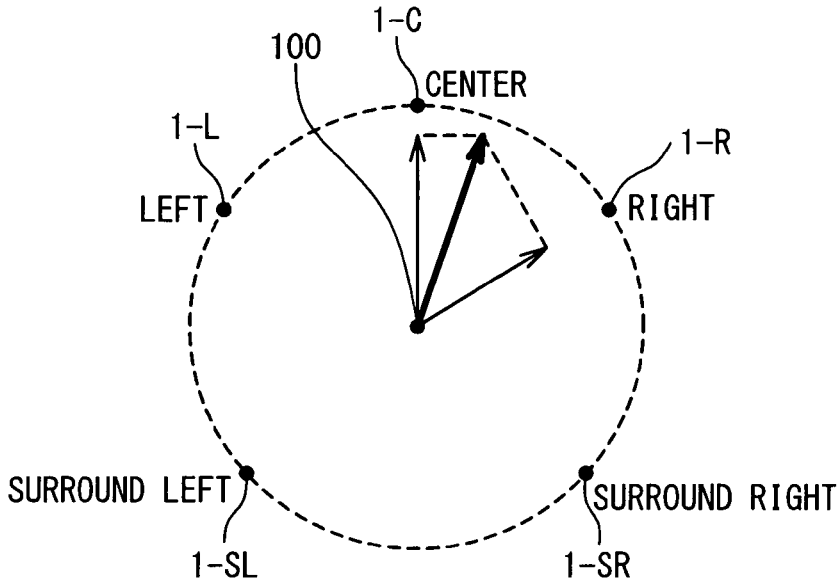
FIG. 9 illustrates operation of the sound processor according to the first embodiment to which the 5.1 channel surround system is applied.

The coefficient data analysis section 10 selects the M (M is an integer equal to or greater than two and smaller than N) speakers from the speakers 1-L, 1-C, 1-R, and 1-SR in order of proximity to the terminal point of the virtual sound source vector (or in order of proximity to the virtual additional sound source). As shown in FIG. 9, M is assumed to be two. In this case, the speakers 1-L and 1-C are selected.

As described above, in the case of M being two, angles $\theta_1'$ and $\theta_2'$ between the virtual sound source vector and the two vectors ($V_L$, $V_C$) of the four vectors ($V_L$, $V_C$, $V_R$, $V_{SR}$), corresponding to the two speakers 1-L and 1-C are designated by $\theta_L$ and $\theta_C$, respectively. Moreover, two adjustment coefficients $G_1'$ and $G_2'$ are designated by $G_L'$ and $G_C'$, respectively. In this case, the coefficient data analysis section 10 calculates the two adjustment coefficients $G_L'$ and $G_C'$ based on the following formulae:

$$G_L'=|V|\cos\theta_L, G_C'=|V|\cos\theta_C.$$

In the additional sound processing (Step S4), as shown in FIG. 6, the additional sound processing section 5 calculates two adjusted additional sound signals $A_L'$ and $A_C'$ based on the following formulae:

$$A_L'=A\times G_L', A_C'=A\times G_C'.$$

In the sound output processing (Step S5), the sound signals ($X_1'$ and $X_2'$) of the sound signals $X_L$, $X_C$, $X_R$, $X_{SL}$, and $X_{SR}$, corresponding to the two speakers 1-L and 1-C are designated by $X_L$ and $X_C$, respectively. The sound signals ($X_1''$ to $X_{(N-M)}''$) corresponding to the (N-M) speakers 1-R, 1-SL, and 1-SR are designated by $X_R$, $X_{SL}$, and $X_{SR}$, respectively. In this case, as shown in FIG. 6, the sound superimposition section 6 calculates two superimposed sound signals $XA_L'$ and $XA_C'$ based on the following formulae:

$$XA_L'=X_L+A_L', XA_C'=X_C+A_C'.$$

The sound superimposition section 6 sends the superimposed sound signals $XA_L'$ and $XA_C'$ to the speakers 1-L and 1-C, respectively. The speakers 1-L and 1-C output sounds based on the superimposed sound signals $XA_L'$ and $XA_C'$, respectively. The sound superimposition section 6 sends the sound signals $X_R$, $X_{SL}$ and $X_{SR}$ to the speakers 1-R, 1-SL and 1-SR, respectively. The speakers 1-R, 1-SL and 1-SR output sounds based on the sound signals $X_R$, $X_{SL}$ and $X_{SR}$, respectively.

As described above, in the coefficient data analysis processing (Step S3), the coefficient data analysis section 10 selects the M (M is an integer equal to or greater than two and smaller than N) speakers from the speakers 1-L, 1-C, 1-R, and 1-SR in order of proximity to the terminal point of the virtual sound source vector (or in order of proximity to the virtual additional sound source). However, the present invention is not limited to this. When the distance from the initial point (listener 100) to the terminal point (virtual additional sound source) of the virtual sound source vector (or magnitude of the virtual sound source vector) is shorter than a predetermined standard, there is a possibility that the virtual sound source is not a monopole. Only in the case that the distance is shorter than the standard (and M is two), the coefficient data analysis section 10 selects, from the N speakers, the speaker nearest to the virtual sound source and the speaker most remote from the virtual sound source.

For example, when the magnitude $|V|$ of the virtual sound source vector V is smaller than the predetermined standard and a sum ($|V_L|+|V_C|+|V_R|+|V_{SL}|+|V_{SR}|$) of the magnitudes of the five vectors $V_L$, $V_C$, $V_R$, $V_{SL}$ and $V_{SR}$ is greater than the predetermined standard, the coefficient data analysis section 10 selects, from the N speakers, the speaker nearest to the virtual sound source and the speaker most remote from the virtual sound source. When the speaker nearest to the virtual additional sound source is the speaker 1-C and the speaker most remote from the virtual additional sound source is the speaker 1-SL, the coefficient data analysis section 10 calculates two adjustment coefficients $G_C'$ and $G_{SL}'$ for the speakers 1-C and 1-SL based on the following formulae:

$$G_C'=|V|\cos\theta_C, G_{SL}'=|V|\cos\theta_{SL}.$$

In this case, in the additional sound processing (Step S4), the additional sound processing section 5 calculates two adjusted additional sound signals $A_C'$ and $A_{SL}'$ based on the following formulae:

$$A_C'=A\times G_C', A_{SL}'=A\times G_{SL}'.$$

In the sound output processing (Step S5), the sound superimposition section 6 calculates two superimposed sound signals $XA_C'$ and $XA_{SL}'$ based on the following formulae:

$$XA_C'=X_C\times A_C',XA_{SL}'=X_{SL}\times A_{SL}'.$$

The sound superimposition section 6 sends the superimposed sound signals $XA_C'$ and $XA_{SL}'$ to the speakers 1-C and 1-SL, respectively. The speakers 1-C and 1-SL output sounds based on the superimposed sound signals $XA_C'$ and $XA_{SL}'$, respectively. The sound superimposition section 6 sends the sound signals $X_L$, $X_R$ and $X_{SR}$ to the speakers 1-L, 1-R and 1-SR, respectively. The speakers 1-L, 1-R and 1-SR output sounds based on the sound signals $X_L$, $X_R$ and $X_{SR}$, respectively.

(Effects and Advantages)

According to the sound processor according to the present invention, a new N.1 channel surround system (N is an integer of five or more) is provided.

As described above, it is assumed that N is five and the speakers 1-1 to 1-5 are the speakers 1-L, 1-C, 1-R, 1-SL and 1-SR arranged on the left side, the center side, the right side, the surround left side and the surround right side with respect to the listener 100, respectively. Then, there is a case where it is demanded that the listener 100 hears the additional sounds from left and right directions with respect to the listener 100. In such a case, the general sound processor described above can not realize the demand, since the additional sound signal is superimposed on the sound signals for all speakers 101-1 to 101-N and the speakers 101-1 to 101-N output sounds based on the superimposed sound signals. On the other hand, the sound processor according to the present embodiment selects the speakers 1-L and 1-C based on the five coefficients (magnitudes of the vectors $V_L$, $V_C$, $V_R$, $V_{SL}$ and $V_{SR}$) and the five pieces of position information (directions of the vectors) of the coefficient data, outputs superimposed sounds from the speakers 1-L and 1-C based on the superimposed sound signals generated by superimposing the additional sound signal on the sound signals and outputs sounds from the speakers 1-R, 1-SL and 1-SR based on the sound signals. As described above, the sound processor according to the present embodiment enables that number of the channels (speakers) which output additional sounds is changed from N to M.

Moreover, in the sound processor according to the present embodiment, the channels (speakers) can be used effectively. For example, there is a case where it is demanded that the listener 100 hears a first additional sound from directions of the left and the right with respect to the listener 100 and a second additional sound from directions of the surround left and the surround right with respect to the listener 100. In such a case, the sound processor according to the present invention selects a group of the speakers 1-L and 1-C and another group of the speakers 1-SL and 1-SR based on the five coefficients (magnitudes of vectors $V_L$, $V_C$, $V_R$, $V_{SL}$, and $V_{SR}$) and the five pieces of position information (directions of the vectors) of the coefficient data, outputs first superimposed sounds including the first additional sound from the speakers 1-L and 1-C based on first superimposed sound signals generated by superimposing a first additional sound signal on the sound signals, outputs second superimposed sounds including the second additional sounds from the speakers 1-SL and 1-SR based on second superimposed sound signals generated by superimposing a second additional sound signal on the sound signals, and outputs sound from the speaker 1-R based on the sound signal. As described above, in the sound processor according to the present embodiment, the channels (speakers) can be used effectively.

The above embodiments can be described as the following example. In the following example, numeral in each pair of parentheses indicates the corresponding element indicated by the same numeral in the accompanying drawings. But elements in the following example are not limited to the corresponding elements.

A sound processor is provided. The sound processor includes N (N is an integer of five or more) speakers (1-1 to 1-N), a sound source (2), an additional sound source (3), a coefficient data input section (4), a coefficient data analysis section (10), an additional sound processing section (5) and a superimposition section (6). The N speakers are arranged in a room to surround a listener (100). The coefficient data input section inputs N pieces of position information indicating respectively positions of the N speakers and N coefficients indicating respectively volumes of sounds outputted from the N speakers based on the additional sound signal. The coefficient data analysis section generates M (M is an integer equal to or greater than two and smaller than N) adjustment coefficients based on the N pieces of position information and the N coefficients. The M adjustment coefficients indicate volumes of sounds outputted from M speakers of the N speakers based on the additional sound signal. The additional sound processing section generates M adjusted additional sound signals by multiplying the additional sound signal by the M adjustment coefficients, respectively. The superimposition section generates M superimposed sound signals by superimposing respectively the M adjusted additional sound signals on M sound signals of the N sound signals. The M speakers output respectively sounds based on the M superimposed sound signals. Remaining (N-M) speakers of the N speakers output respectively sounds based on the remaining (N-M) sound signals of the N sound signals.

According to the above example, a new N.1 (N is an integer of five or more) channel surround system is provided.

There is a case where it is demanded that the listener (100) hears additional sounds from left and right directions with respect to the listener (100). In such a case, the general sound processor described above can not realize the demand, since the additional sound signal is superimposed on the sound signals for all speakers (101-1 to 101-N) and the speakers (101-1 to 101-N) output sounds based on the superimposed sound signals. On the other hand, the sound processor according to the above example selects, as the M (M is an integer equal to or greater than two and smaller than N) speakers of the N speakers, the speakers (in this case, M is two) of the left side and the center side with respect to the listener (100) based on the five coefficients (magnitudes of the vectors $V_1$ to $V_N$) and the five pieces of position information (directions of the vectors) of the coefficient data, outputs sounds from the speakers of the left side and center side based on the superimposed sound signals provided by superimposing the additional sound signal on the signals, and outputs sounds from the other speakers other than the speakers of the left side and the center side based on the sound signals. Accordingly, the sound processor according to the above example enables that number of the channels (speakers) which output additional sounds is changed from N to M.

It is assumed that N is five and the speakers (1-1 to 1-5) are the speakers (1-L, 1-C, 1-R, 1-SL and 1-SR) arranged on the left side, the center side, the right side, the surround left side and the surround right side with respect to the listener 100, respectively. The sound processor according to the above example selects the speakers (1-L and 1-C) based on the five coefficients (magnitudes of the vectors ($V_L$, $V_C$, $V_R$, $V_{SL}$ and $V_{SR}$)) and the five pieces of position information (directions of the vectors) of the coefficient data, outputs sounds from the speakers (1-L and 1-C) based on the superimposed sound signals provided by superimposing the additional sound signal on the sound signals, and outputs sounds from the speakers (1-R, 1-SL and 1-SR) based on the sound signals. Accordingly, the sound processor according to the above example enables that the speakers to output additional sound are changed from all the speakers to two of the speakers.

Moreover, in the sound processor according to the above example, the channels (speakers) can be used effectively. For example, there is a case where it is demanded that the listener (100) hears a first additional sound from directions of the left and the right with respect to the listener (100) and a second additional sound from directions of the surround left and the surround right with respect to the listener (100). In such a case, the sound processor according to the above example selects a group of the speakers (1-L and 1-C) and another group of the speakers (1-SL and 1-SR) based on the five coefficients (magnitudes of vectors ($V_L$, $V_C$, $V_R$, $V_{SL}$, and $V_{SR}$)) and the five pieces of position information (directions of the vectors) of the coefficient data, outputs first superimposed sounds the first additional sound from the speakers (1-L and 1-C) based on first superimposed sound signals generated by superimposing a first additional sound signal on the sound signals, outputs second superimposed sounds including the second additional sound from the speakers (1-SL and 1-SR) based on second superimposed sound signals generated by superimposing a second additional sound signal on the sound signals, and outputs sound from the speaker (1-R) based on the sound signal. Accordingly, in the sound processor according to the above example, the channels (speakers) can be used effectively.

It is apparent that the present invention is not limited to the above embodiments, but may be modified and changed without departing from the scope and spirit of the invention.

What is claimed is:

1. A sound processor comprising:

N (N is an integer of five or more) speakers;

a sound source configured to output N sound signals;

an additional sound source configured to output an additional sound signal;

a coefficient data input section configured to input N pieces of position information indicating respectively positions of said N speakers and N coefficients indicating respectively volumes of sounds outputted from said N speakers based on said additional sound signal;

a coefficient data analysis section configured to generate M (M is an integer equal to or greater than two and smaller than N) adjustment coefficients based on said N pieces of position information and said N coefficients wherein said M adjustment coefficients indicate volumes of sounds outputted from M speakers of said N speakers based on said additional sound signal;

an additional sound processing section configured to generate M adjusted additional sound signals based on said additional sound signal and said M adjustment coefficients; and a superimposition section configured to generate M superimposed sound signals by superimposing respectively said M adjusted additional sound signals on M sound signals of said N sound signals, wherein said M speakers output respectively sounds based on said M superimposed sound signals, and remaining (N-M) speakers of said N speakers output respectively sounds based on remaining (N-M) sound signals of said N sound signals.

2. The sound processor according to claim 1, wherein said N speakers are arranged to surround a listener, magnitudes $|V_1|$ to $|V_N|$ of N vectors correspond respectively to said N coefficients, directions of said N vectors correspond respectively to said positions indicated by said N pieces of position information, initial points of said N vectors correspond to said listener, a virtual sound source vector is determined by said N vectors and said directions, angles between said virtual sound source vector and said N vectors are respectively designated by $\theta_1$ to $\theta_N$, said coefficient data analysis section calculates a magnitude $|V|$ of said virtual sound source vector V based on $$|V|=|V_1|\cos\theta_1+\ldots+|V_N|\cos\theta_N,$$

said coefficient data analysis section select said M speakers from said N speakers in order of proximity to a terminal point of said virtual sound source vector, angles between said virtual sound source vector and M vectors of said N vectors, corresponding to said M speakers are respectively designated by $\theta_1'$ to $\theta_M'$, said M adjustment coefficients are respectively designated by $G_1'$ to $G_M'$, and said coefficient data analysis section calculate said M adjustment coefficients based on $$G_1'=|V|\cos\theta_1',\ldots,G_M'=|V|\cos\theta_M'.$$

3. The sound processor according to claim 2, wherein said additional sound signal is designated by A, said M adjusted additional sound signals are designated by $A_1'$ to $A_M'$, said additional sound processing section calculates said M adjusted additional sound signals based on $$A_1'=A\times G_1',\ldots,A_M'=A\times G_M',$$

said N sound signals are designated by $X_1$ to $X_N$, said M sound signals of said N sound signals $X_1$ to $X_N$, corresponding to said M speakers are respectively designated by $X_1'$ to $X_M'$, said remaining (N-M) sound signals of said N sound signals, corresponding to said remaining (N-M) speakers are respectively designated by $X_1''$ to $X_{(N-M)}''$, said M superimposed sound signals are designated by $XA_1'$ to $XA_M'$, said sound superimposition section calculates said M superimposed sound signals $XA_1'$ to $XA_M'$ based on $$XA_1'=X_1'+A_1',\ldots,XA_M'=X_M'+A_M',$$

said M speakers output respectively sounds based on said M superimposed sound signals $XA_1'$ to $XA_M'$, and said remaining (N-M) speakers output respectively sounds based on said sound signals $X_1''$ to $X_{(N-M)}''$.

4. The sound processor according to claim 1, wherein said N speakers are arranged based on N.1 channel surround system.

5. A controller for sound processing, comprising:

a coefficient data input section configured to input N (N is an integer of five or more) pieces of position information indicating respectively positions of N speakers and N coefficients indicating respectively volumes of sounds outputted from said N speakers based on an additional sound signal outputted from an additional sound source;

a coefficient data analysis section configured to generate M (M is an integer equal to or greater than two and smaller than N) adjustment coefficients based on said N pieces of position information and said N coefficients wherein said M adjustment coefficients indicate volumes of sounds outputted from M speakers of said N speakers based on said additional sound signal;

an additional sound processing section configured to generate M adjusted additional sound signals based on said additional sound signal and said M adjustment coefficients; and a superimposition section configured to generate M superimposed sound signals by superimposing respectively said M adjusted additional sound signals on M sound signals of N sound signals outputted from a sound source, wherein said M speakers output respectively sounds based on said M superimposed sound signals, and remaining (N-M) speakers of said N speakers output respectively sounds based on remaining (N-M) sound signals of said N sound signals.

6. The controller for sound processing according to claim 5, wherein said N speakers are arranged to surround a listener, magnitudes $|V_1|$ to $|V_N|$ of N vectors correspond respectively to said N coefficients, directions of said N vectors correspond respectively to said positions indicated by said N pieces of position information, initial points of said N vectors correspond to said listener, a virtual sound source vector is determined by said N vectors and said directions, angles between said virtual sound source vector and said N vectors are respectively designated by $\theta_1$ to $\theta_N$, said coefficient data analysis section calculates a magnitude $|V|$ of said virtual sound source vector based on $$|V|=|V_1|\cos\theta_1+\ldots+|V_N|\cos\theta_N,$$

said coefficient data analysis section select said M speakers from said N speakers in order of proximity to a terminal point of said virtual sound source vector, angles between said virtual sound source vector and M vectors of said N vectors, corresponding to said M speakers are respectively designated by $\theta_1'$ to $\theta_M'$, said M adjustment coefficients are respectively designated by $G_1'$ to $G_M'$, and said coefficient data analysis section calculate said M adjustment coefficients based on $$G_1'=|V|\cos\theta_1',\ldots,G_M'=|V|\cos\theta_M'.$$

7. The controller for sound processing according to claim 6, wherein said additional sound signal is designated by A, said M adjusted additional sound signals are designated by $A_1'$ to $A_M'$, said additional sound processing section calculates said M adjusted additional sound signals based on $$A_1'=A\times G_1',\ldots,A_M'=A\times G_M',$$

said N sound signals are designated by $X_1$ to $X_N$, said M sound signals of said N sound signals $X_1$ to $X_N$, corresponding to said M speakers are respectively designated by $X_1'$ to $X_M'$, said remaining (N-M) sound signals of said N sound signals, corresponding to said remaining (N-M) speakers are respectively designated by $X_1''$ to $X_{(N-M)}''$, said M superimposed sound signals are designated by $XA_1'$ to $XA_M'$, said sound superimposition section calculate said M superimposed sound signals $XA_1'$ to $XA_M'$ based on $$XA_1'=X_1'+A_1',\ldots,XA_M'=X_M'+A_M',$$

said sound superimposition section sends said M superimposed sound signals $XA_1'$ to $XA_M'$ respectively to said M speakers, and said sound superimposition section sends said sound signals $X_1''$ to $X_{(N-M)}''$ respectively to said remaining (N-M) speakers.

8. The controller for sound processing according to claim 5, wherein said N speakers are arranged based on N.1 channel surround system.

9. A sound processing method comprising:

outputting N (N is an integer of five or more) sound signals corresponding to N speakers;

outputting an additional sound signal;

inputting N pieces of position information indicating respectively positions of said N speakers and N coefficients indicating respectively volumes of sounds outputted from said N speakers based on said additional sound signal;

generating M (M is an integer equal to or greater than two and smaller than N) adjustment coefficients based on said N pieces of position information and said N coefficients wherein said M adjustment coefficients indicate volumes of sounds outputted from M speakers of said N speakers based on said additional sound signal;

generating M adjusted additional sound signals based on said additional sound signal and said M adjustment coefficients; and generating M superimposed sound signals by superimposing respectively said M adjusted additional sound signals on M sound signals of said N sound signals, wherein said M speakers output respectively sounds based on said M superimposed sound signals, and remaining (N-M) speakers of said N speakers output respectively sounds based on remaining (N-M) sound signals of said N sound signals.

* * * * *